US011933028B2

(12) United States Patent
McCutcheon

(10) Patent No.: US 11,933,028 B2
(45) Date of Patent: Mar. 19, 2024

(54) ADJUSTABLE FLUIDIC COUPLING

(71) Applicant: Caroma Industries Limited, North Sydney (AU)

(72) Inventor: Stephen McCutcheon, Auckland (NZ)

(73) Assignee: Caroma Industries Limited, North Sydney (AU)

( * ) Notice: Subject to any disclaimer, the term of this patent is extended or adjusted under 35 U.S.C. 154(b) by 109 days.

(21) Appl. No.: 17/828,836

(22) Filed: May 31, 2022

(65) Prior Publication Data

US 2022/0396935 A1 Dec. 15, 2022

(30) Foreign Application Priority Data

May 31, 2021 (AU) ..... 2021901622

(51) Int. Cl.
*E03C 1/042* (2006.01)
*E03C 1/04* (2006.01)

(52) U.S. Cl.
CPC ..... *E03C 1/042* (2013.01); *E03C 1/0403* (2013.01); *E03C 1/0408* (2013.01); *Y10T 137/9464* (2015.04)

(58) Field of Classification Search
CPC ..... E03C 1/042; E03C 1/0403; E03C 1/0408; Y10T 137/9464
USPC ..... 137/801
See application file for complete search history.

(56) References Cited

U.S. PATENT DOCUMENTS 904,673 A * 11/1908 Bideker ..... F16L 27/0845 239/587.5
2,381,829 A * 8/1945 Livers ..... F16L 19/046 285/332.3
5,076,616 A * 12/1991 Williamson ..... F16L 19/0218 285/332.3
6,598,908 B1 * 7/2003 Wosik ..... F16L 19/055 285/332.3
6,971,683 B2 * 12/2005 Mizukoshi ..... F16L 19/0283 285/354
7,032,934 B2 * 4/2006 Wosik ..... F16L 19/055 285/332.2
8,024,822 B2 * 9/2011 Macan ..... E03C 1/0408 4/615
2015/0226355 A1 * 8/2015 Ungchusri ..... F16L 19/0218 285/354

* cited by examiner

*Primary Examiner* — John Bastianelli
(74) *Attorney, Agent, or Firm* — Quarles & Brady LLP

(57) ABSTRACT

An adjustable fluidic coupling includes a fluid channel extending between an upstream fluid inlet and a downstream fluid outlet. An inlet part includes a first conduit extending therethrough between the inlet at an upstream end and a first connection port at a downstream end portion. An outlet part includes a second conduit extending therethrough between the outlet at a downstream end and a second connection port at an upstream end portion. The coupling further includes a compression member selectively movable between a first position and a second position. The fluid inlet includes a threaded portion for torqued threaded connection of the inlet to a threaded end of the wall outlet, and an inlet seal fluidly sealing the inlet port to the wall outlet.

22 Claims, 9 Drawing Sheets

ADJUSTABLE FLUIDIC COUPLING

CROSS REFERENCES TO RELATED APPLICATIONS

This application claims the benefit of Australian Patent Application No. 2021901622, filed May 31, 2021, which is hereby incorporated by reference in its entirety.

FIELD

The invention relates to plumbing fixtures and particularly fixed outlet points for dispensing water. The invention will be described with reference to wall outlets for shower fixtures however it will be appreciated that the invention may be used in other application such as plumbing outlets for faucets, spouts or other fixtures.

BACKGROUND

Plumbing outlets points, such as those for dispensing water commonly comprise a simple externally threaded pipe emerging from a wall at the outlet point. The pipe may be horizontal or include in some cases, a downward bend commonly called a shower arm. One method of coupling outlet fittings such as shower heads or adaptors to the outlet is to screw the shower head, having a complementary threaded connector, on to the outlet and sandwich a rubber washer between the shower head and the end surface of the outlet. The connection is tightened sufficiently to create a sealed fluidic coupling. Alternatively, plumbers' tape may be wrapped around the threads of the outlet to provide a seal and the connection is tightened sufficiently to create a sealed fluidic coupling.

While the above methods are simple and typically reliable, mechanically, the coupling provides little angular resistance because it is only the friction of the washer on the shower arm or the tape which prevents rotation. This can make installation of an outlet fitting such as a shower head problematic. Increasing the tightening torque provides a limited solution at the risk of causing the sealing washer to fail. Thus, any off-centre loads placed on the shower head tend to rotate the coupling resulting in misalignment and/or loosening of the coupling which may result in leaking. In addition, if the fitting has a specific orientation, it must be both torqued to the outlet sufficient to ensure an adequate seal and set to the required orientation. This can be hit and miss given that the orientation is typically only correct once every full rotation of the fitting.

It is an object of the present invention to overcome or ameliorate at least one of the disadvantages of the prior art, or to provide a useful alternative.

SUMMARY OF INVENTION

In a first aspect, the invention provides an adjustable fluidic coupling to be fitted to a fluid dispensing wall outlet, wherein the coupling comprises:

a fluid channel extending between an upstream fluid inlet and a downstream fluid outlet;

an inlet part formed of at least one tubular body and comprising a first conduit extending therethrough along a first longitudinal axis between the inlet at an upstream end and a first connection port at a downstream end portion, said port having a first fluid opening and a first circumferential tapered mating surface aligned on a first port axis;

an outlet part formed of at least one tubular body and comprising a second conduit extending therethrough along a second longitudinal axis between a second connection port at an upstream end portion, said second port comprising a second fluid opening and a second circumferential tapered mating surface aligned on a second port axis, and a third opening at a downstream end portion;

a stem part comprising a stem axis and fluid passageway extending between a fourth opening at an upstream end portion and the outlet at a downstream end portion;

wherein the first and second ports are configured for complementary tapered engagement of the first and second mating tapered surfaces on aligned port axes to connect the inlet part to the outlet part such that the first and second conduits are in fluid communication via the first and second openings and form said fluid channel between the inlet and the outlet;

wherein said outlet part is fixedly connected to said stem such that said second conduit and said passageway are fluidly connected by said third and fourth openings;

a compression member selectively movable between a first position holding the first and second mating surfaces in abutment for free rotation of the inlet part about the coaligned port axes relative to the outlet part thereby providing for angular adjustment of the inlet relative to the outlet, and a second position whereby the first mating surface is compressively engaged with the second mating surface to frictionally bind the first and second mating surfaces to angularly fix the inlet relative to the outlet;

wherein said fluid inlet comprises a threaded portion for torqued threaded connection of said inlet to a threaded end of said wall outlet, to thereby resist relative rotation of said coupling relative to said outlet; and an inlet seal fluidly sealing the inlet port to the wall outlet.

Preferably, said inlet seal comprises:

an annular seal mounted within the inlet adjacent the threaded portion, said annular seal providing a fluid seal between an inner cylindrical surface portion of the first conduit and an annular end surface of said wall outlet; and a resilient member for biasing the annular seal into sealing engagement with the annular end surface of said wall outlet.

Preferably, said annular seal comprises:

a tubular seal carrier slidably mounted within the cylindrical surface portion of the first conduit, said carrier having an annular seal seat for seating an annular seal member for sealing against the annular end surface of said wall outlet;

a first ring seal for providing a fluid seal between an outer surface of said tubular seal carrier and the cylindrical surface portion of the first conduit.

Preferably, the tubular seal carrier and annular seal member are slidable between an extended position where the annular seal member is within the threaded portion of the fluid inlet, and a retracted position where the annular seal member is in the first conduit downstream of the threaded portion of the fluid inlet.

Preferably, the tubular seal carrier includes a tubular wall extending axially from a periphery of the annular seal seat, the tubular wall including a circumferential groove for receiving and locating the first ring seal.

Preferably, said first and second tapered mating surfaces are complementary frustoconical machine tapers.

Preferably, said machine tapers are self-releasing.

Preferably, the tubular body of the inlet part is a first tubular body, having a first longitudinal axis and a first tubular wall defining said first conduit, and wherein said inlet and the first downstream opening are disposed at respective upstream and downstream ends thereof.

Preferably, the tubular body of the outlet part is a second tubular body having a second longitudinal axis and a second tubular wall defining said second conduit, and wherein said second downstream opening and said outlet are disposed at respective upstream and downstream ends thereof.

Preferably, said first mating surface is disposed on an inner surface of the first tubular wall of the first tubular body and said second mating surface is disposed on an outer surface of the second tubular wall of the second tubular body.

Preferably, said second tubular body is telescopically received within the first tubular body to extend from the first downstream opening thereof.

Preferably, second tubular body extends at least partially into said first tubular body.

Preferably, the adjustable fluidic coupling further includes a second ring seal disposed between an inner surface of the first conduit and an outer surface of said second tubular body adjacent the second opening to provide a fluidic seal between the coupling inlet part and the coupling outlet part.

Preferably, the adjustable fluidic coupling further includes a circumferential groove disposed on the outer surface of second tubular body for receiving and locating the second ring seal.

Preferably, said stem extends transverse said second tubular body.

Preferably, said stem axis is at an angle to said second longitudinal axis.

Preferably, said angle is around 90 degrees.

Alternatively, said angle is around 45 degrees.

Preferably, said stem comprises a third tubular body and an angled connector;

and wherein said second and third tubular bodies are fixedly connected to the connector at respective downstream and upstream end portions such that the second and third conduits are in fluid communication via an interconnecting fluid passageway through said connector.

Preferably, said second conduit is closed at a downstream end and said third opening extends through a sidewall of said downstream end portion of said second tubular body.

Preferably, said compression member is a tubular travelling nut surrounding said first tubular body and threadably engaged therewith such that rotation of said compression member causes axial travel of said compression member with respect to said first tubular body between said first and second positions.

Preferably, said compression member includes a first compression surface for engaging a second compression surface disposed on said coupling outlet part when in said second position to invoke compressive engagement of the first mating surface with the second mating surface.

Preferably, the adjustable fluidic coupling further includes a torqueing tool having a rotational drive formation for engaging complementary first and second tool engagement formations located respectively on the first tubular body and the compression member.

Preferably, the tool includes a tubular tool sleeve coaxially mounted on said coupling for slidable movement between a first and second positions wherein said rotational drive formation is disposed on an inner surface of said sleeve; such that in the first position said rotational drive formation is engaged with said first tool engagement formations and in the second position said rotational drive formation is engaged with said second tool engagement formations.

Preferably, the tool includes a handle extending radially from said tubular tool sleeve.

Preferably, the rotational drive formation and the first and second tool engagement formations have a hexagonal profile.

In another aspect, the invention provides an adjustable fluidic coupling to be fitted to a fluid dispensing wall outlet, wherein the coupling comprises:

a fluid channel extending between an upstream fluid inlet and a downstream fluid outlet;

an inlet part formed of at least one tubular body and comprising a first conduit extending therethrough between the inlet at an upstream end and a first connection port at a downstream end portion, said port having a first fluid opening and a first circumferential tapered mating surface aligned on a first port axis;

an outlet part formed of at least one tubular body and comprising a second conduit extending therethrough between the outlet at a downstream end and a second connection port at an upstream end portion, said second port comprising a second fluid opening and a second circumferential tapered mating surface aligned on a second port axis;

wherein the first and second ports are configured for complementary tapered engagement of the first and second mating tapered surfaces on aligned port axes to connect the inlet part to the outlet part such that the first and second conduits are in fluid communication via the first and second openings and form said fluid channel between the inlet and the outlet;

a compression member selectively movable between a first position holding the first and second mating surfaces in abutment for free rotation of the inlet part about the coaligned port axes relative to the outlet part thereby providing for angular adjustment of the inlet relative to the outlet, and a second position whereby the first mating surface is compressively engaged with the second mating surface to frictionally bind the first and second mating surfaces to angularly fix the inlet relative to the outlet;

wherein said fluid inlet comprises a threaded portion for torqued threaded connection of said inlet to a threaded end of said wall outlet, to thereby resist relative rotation of said coupling relative to said outlet; and an inlet seal fluidly sealing the inlet port to the wall outlet.

An adjustable fluidic coupling to be fitted to a fluid dispensing wall outlet, wherein the coupling comprises:

a fluid channel extending between an upstream fluid inlet and a downstream fluid outlet;

an inlet part formed of at least one tubular body and comprising a first conduit extending therethrough between the inlet at an upstream end and a first fluid port at a downstream end portion, said port having a first circumferential tapered mating surface surrounding said first conduit;

an outlet part formed of at least one tubular body and comprising a second conduit extending therethrough between the outlet at a downstream end and a second connection port at an upstream end portion, said second port comprising a second circumferential tapered mating surface surrounding said second conduit;

wherein the first and second ports are configured for complementary tapered engagement of the first and second mating tapered surfaces;

a compression member selectively movable between a first position holding the first and second mating surfaces in abutment for free rotation of the inlet part relative to the outlet part thereby providing for angular adjustment of the inlet relative to the outlet, and a second position whereby the first mating surface is compressively engaged with the second mating surface to frictionally bind the first and second mating surfaces to angularly fix the inlet relative to the outlet;

wherein said fluid inlet comprises a threaded portion for torqued threaded connection of said inlet to a threaded end of said wall outlet, to thereby resist relative rotation of said coupling relative to said outlet; and an inlet seal fluidly sealing the inlet port to the wall outlet.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

BRIEF DESCRIPTION OF DRAWINGS

The invention will be more clearly understood from the following description of an embodiment thereof, given by way of example only, with reference to the accompanying drawings, in which:—

DESCRIPTION OF EMBODIMENTS

Figure 2:
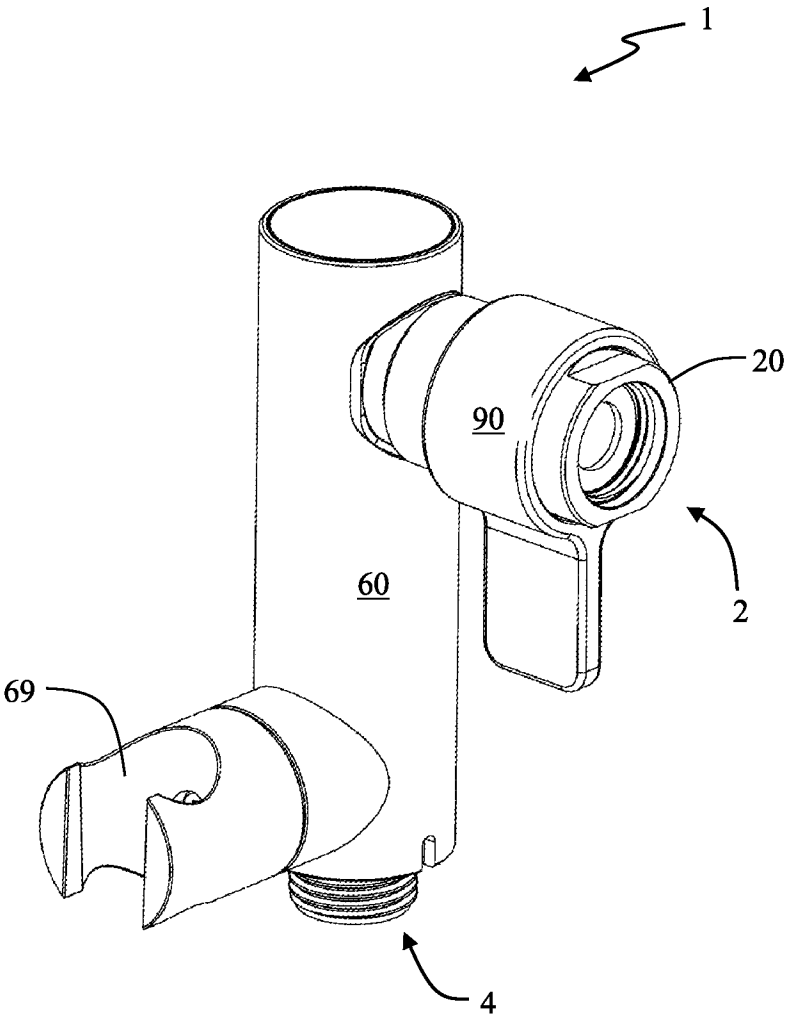
FIG. 2 is a rear perspective view of the adjustable fluidic coupling shown in FIG. 1.
Figure 1:
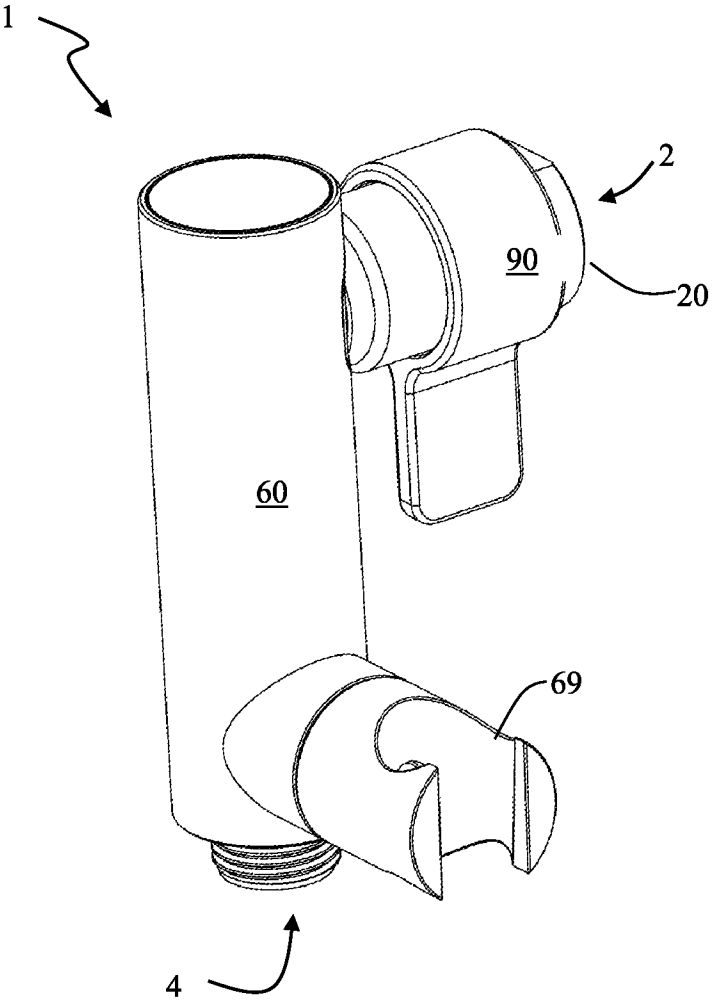
FIG. 1 is a front perspective view of an adjustable fluidic coupling in accordance with the invention.
Figure 3:
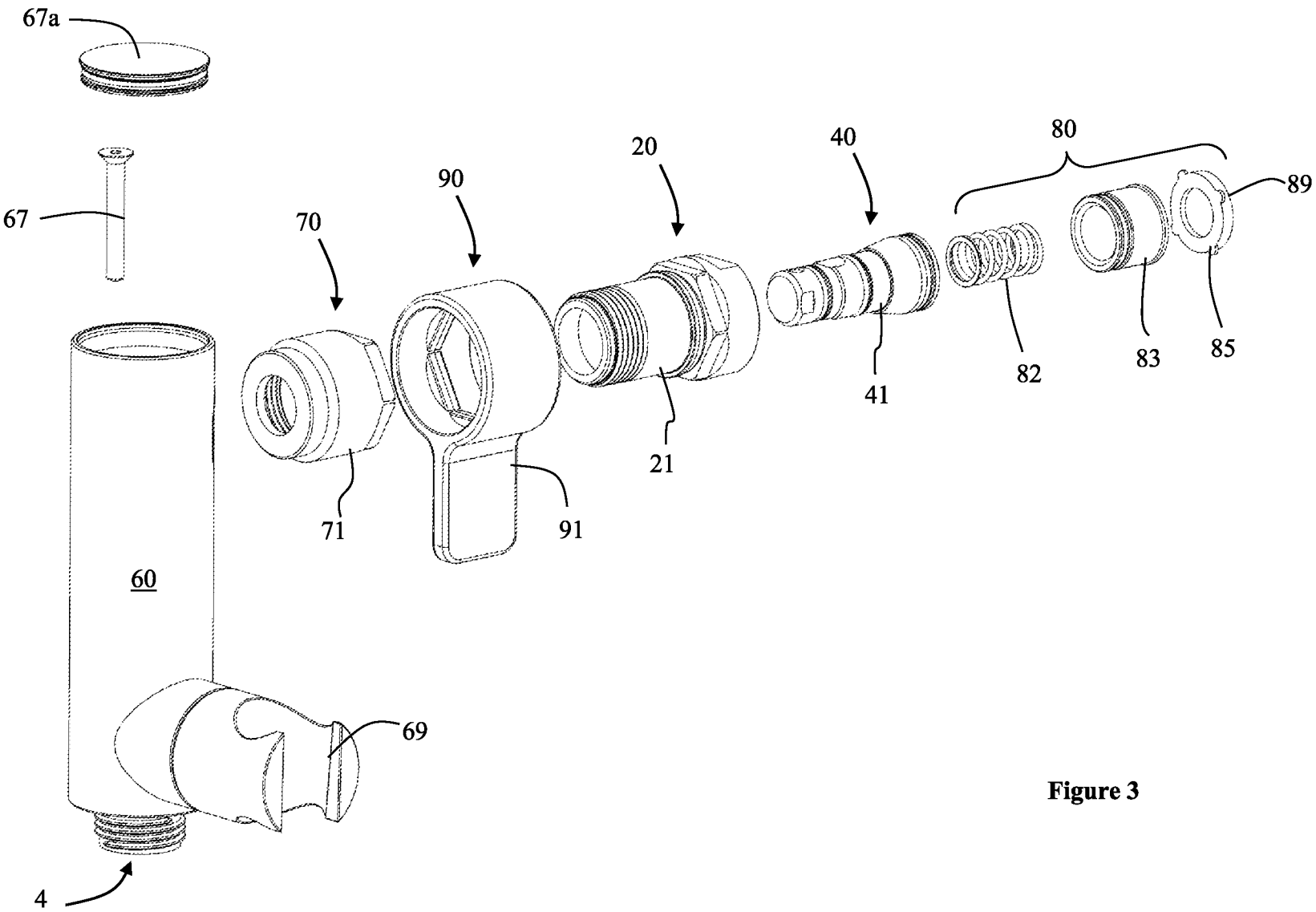
FIG. 3 is an exploded front perspective view of the adjustable fluidic coupling shown in FIG. 1.
Figure 7:
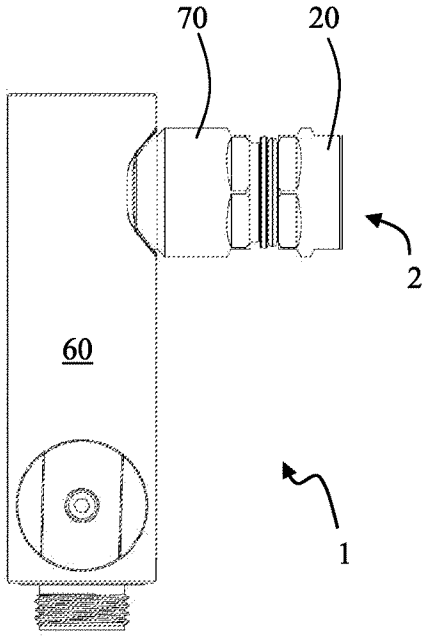
FIG. 7 is a side view of the adjustable fluidic coupling shown in FIG. 1 with the torqueing tool removed.
Figure 5:
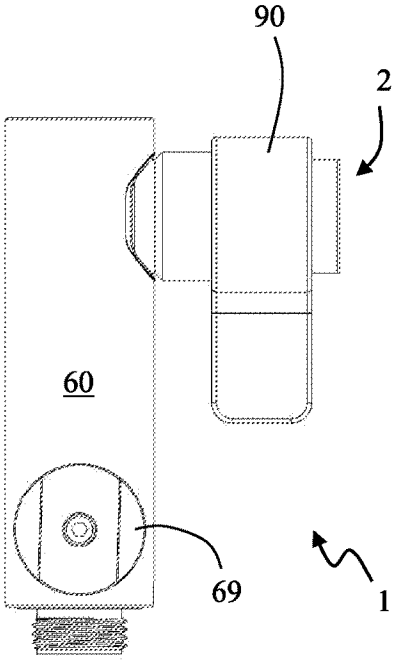
FIGS. 4-6 are front, side and top views of the adjustable fluidic coupling shown in FIG. 1.
Figure 6:
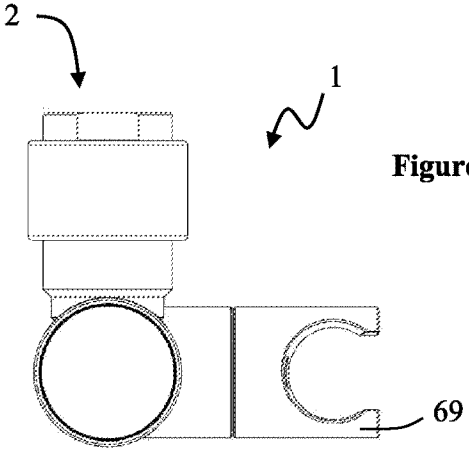
Figure 4:
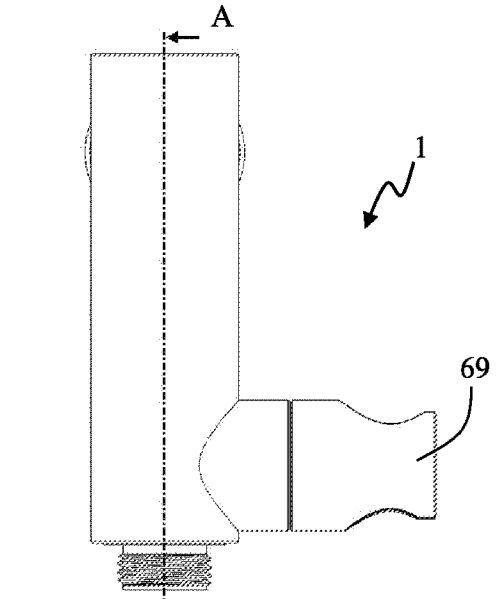

An adjustable fluidic coupling 1 to be fitted to a wall outlet 100 for dispensing a fluid is shown in the figures. The adjustable fluidic coupling comprises an upstream fluid inlet 2 and a downstream fluid outlet 4 connected by a fluid channel 5 (see FIG. 8).

An inlet part 20 is formed of at least one body, comprises a first conduit 22 extending therethrough along a first longitudinal axis 23 between a first connection port 24 at a downstream end portion and the inlet 2 at an upstream end. The first port 24 has a first fluid opening 26 and a first circumferential tapered mating surface 27 surrounding said first conduit aligned on a first port axis 28.

In some embodiments the inlet part 20 may be formed of multiple sections and/or bodies joined in series, however in this embodiment the at least one body of the inlet part is a single, first tubular body 21.

An outlet part 40 having at least one body 41, comprises a second conduit 42 extending therethrough along a second longitudinal axis 43 between a second connection port 44 at an upstream end portion and a third opening 45 at a downstream end portion. The second port 44 comprises a second fluid opening 46 and a second circumferential tapered mating surface 47 surrounding said first conduit aligned on a second port axis 48.

In some embodiments the outlet part 40 may be formed of multiple sections and/or bodies joined in series to provide the first conduit, however in this embodiment the at least one body of the outlet part is a single second tubular body 41.

In still further embodiments, the outlet 4 is disposed at the downstream end portion of the outlet part 40, however in the embodiment shown in the figures and described herein, the coupling 1 further includes a stem part 60 supporting the outlet 4 and connected to the second tubular body 41. The stem part 60 has at least one body and comprises a fluid passageway 62 extending along a stem axis 63 between a fourth opening 64 at an upstream end portion and the outlet 4 at a downstream end portion. The second tubular body 41 is fixedly connected to said stem part 60 such that the second conduit 42 and said passageway 62 are fluidly connected by said third and fourth openings (45 & 64).

The first and second tubular bodies (21 & 41) are connected via the first and second ports (24 & 44) by complementary engagement of the circumferential tapered mating surfaces (27 & 47) such that the first and second conduits (22 & 42) are in fluid communication via the first and second openings (26 & 46) and together with the stem part 60 and fluid passageway 62, form the fluid channel 5 between the inlet 2 and the outlet 4. In this embodiment, the respective first and second tapered mating surfaces (27 & 47) are complementary, male and female frustoconical machine tapers, which provide for self-aligning engagement on coaligned port axes (28 & 48). Furthermore, in this embodiment each of the port axes (28 & 48) are coaligned with the respective longitudinal axes (23 & 43). A circumferential fluid seal between the first tubular body 21 and the second tubular body 41 is provided to seal the fluid connection between the first and second conduits (22 & 42).

Preferably the tapered mating surfaces (27 & 47) rely on frictional engagement allowing for indiscrete angular adjustment between the first and second tubular bodies (21 & 41). Advantageously this allows the outlet to be set at any angle with respect to the inlet rather than be limited to a finite number of positions as would be dictated by a splined connection.

A compression member 70 is provided for holding the first and second mating surfaces (27 & 47) in abutment. The compression member 70 is movable between a first position wherein the inlet part 220 is free to rotate about the common longitudinal conduit axes relative to the outlet part 40 thereby providing for angular adjustment of the fluid inlet 2 relative to the fluid outlet 4, and a second position whereby the first mating surface 27 is compressively engaged with the second mating surface 47 to frictionally bind the first tubular body 21 relative to the second tubular body 41 thereby providing for angular fixation of the fluid inlet 2 relative to the fluid outlet 4.

A threaded portion 30 is disposed at the fluid inlet 2 for providing torqued mechanical connection of the coupling 1 to a threaded end 101 of the wall outlet 100, to thereby resist relative rotation of the inlet part 20 relative to the outlet 100. Fluid sealing of the channel 5 to the outlet 100 is provided by an annular seal 80 mounted within the inlet 2, adjacent the threaded portion 30. The annular seal 80 is configured to seal the first conduit 22 with an annular end surface 102 of the wall outlet 100 (see FIG. 9) and to provide, by means of center aperture 81 a passage for the transmission of fluid from the outlet 100 into fluid channel 5 of the coupling 1. A resilient member 82 is provided for biasing the annular seal 80 into sealing engagement with the annular end surface 102.

Figure 10:
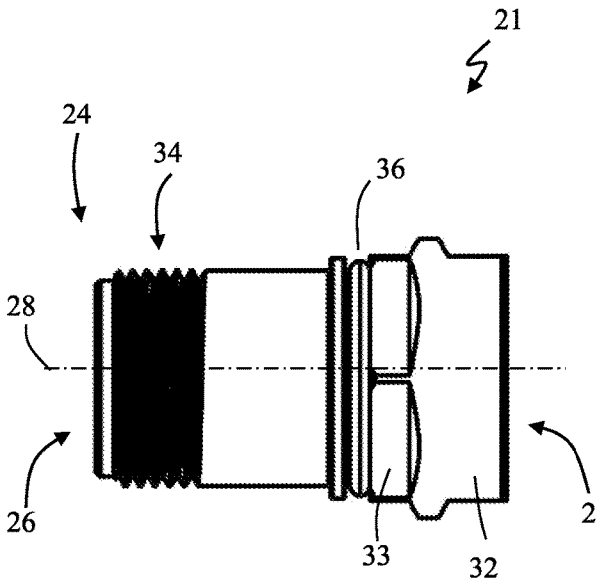
FIGS. 10 and 11 are a side view of a first tubular body in accordance with the invention and a section side view thereof taken on section plane 10-10 respectively.
Figure 11:
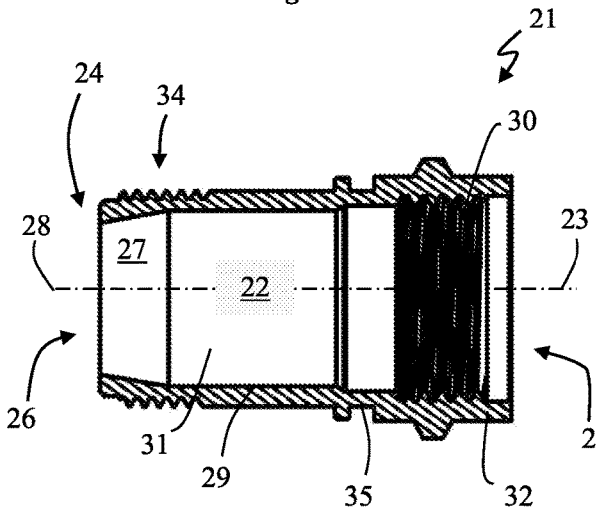

As best seen in side view FIG. 10 and sectional side view FIG. 11, the first tubular body 21 comprises a tubular wall 29 defining the first conduit 22 which extends along first longitudinal axis 23 from the inlet 2 at the upstream end to the first opening 26 at the downstream end portion. An inner surface of the tubular wall 29 includes the threaded portion 30 of the inlet 2 at the upstream end, the first circumferential mating surface 27 is disposed at the downstream end and a cylindrical surface portion 31 is disposed therebetween. As can be seen in the figures, in this embodiment, the conduit 22 narrows from the inlet 2 to the first opening 26. More particularly the first circumferential mating surface 27, is a female, frustoconical machine taper, facing inwardly toward the first port axis 28 and in the upstream direction, toward the inlet 2. The first connection port 24 comprising the first opening 26 and the first circumferential mating surface 27 are centered on the first port axis 28 which is coaligned with the first longitudinal axis 23 and inlet 2.

An external surface of the of the tubular wall 29 includes an enlarged flange portion 32 at the upstream end portion, a first tool engagement formation 33 axially downstream of the enlarged flange portion 32 and a threaded portion 34 toward the downstream end. The first tool engagement formation 33 provides for engagement of a torqueing tool to apply torque to the inlet part 20 for tightening or loosening the threaded connection between the threaded portion 30 at the inlet 2, and the threaded end 101 of the wall outlet 100 during connection. As can be seen with reference to FIGS. 2 and 10, in this embodiment the tool engagement formation 33 is provided by a portion of the tubular wall 29 having a hexagonal cross-section which allows for engagement of a standard spanner if required, however other formations for applying torque to the first member may be used. A circumferential groove 35 is provided between the tool engagement formation 33 and the threaded portion 34 for receiving a resilient O-ring 36.

Figure 12:
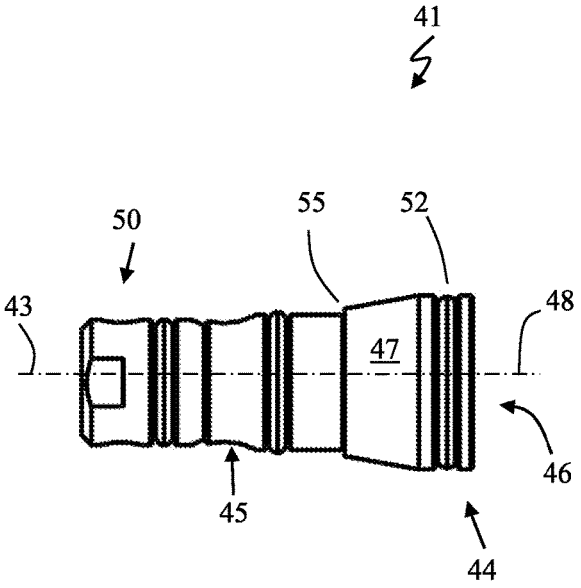
FIGS. 12 and 13 are a side view of a second tubular body in accordance with the invention and a section side view thereof taken on section plane 12-12 respectively.
Figure 13:
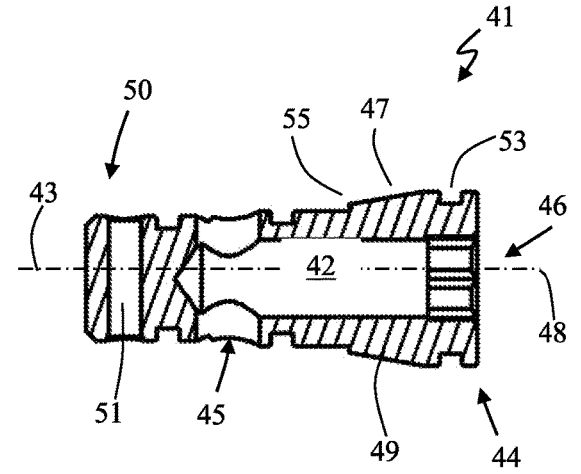

Again, as best seen in side view FIG. 12 and sectional side view FIG. 13, the second tubular body 41 comprises a tubular sidewall 49 defining the second conduit 42 which extends along second longitudinal axis 43 from second opening 46 at the upstream end to a third opening 45 at a downstream end portion.

The second opening 46 is made in the upstream axial end of second tubular body 41 and both it and the second circumferential mating surface 47 are centered on the longitudinal axis 43. In some embodiments, such as that shown in FIGS. 20 to 22, the third opening 45 is in the downstream axial end of second body 41.

However, in the embodiment shown in FIGS. 1-9 and FIGS. 12 and 13, the second conduit is closed at a downstream axial end and said third opening 45 extends through the tubular sidewall of said downstream end portion of the second tubular body 41. In this embodiment the third opening is formed as a bore extending wholly through the second tubular to intersect the fluid conduit 42. A downstream end extension 50 of the second body 41 includes an eyelet 51 and is configured for fixing to the stem part 60 and for fluid connection of the second conduit 42 to fluid passageway 62 of the stem part 60.

The external diameter of the tubular wall 49 generally reduces from the upstream end to the downstream end of the second tubular body 41. An external surface of the tubular wall 49 includes the second circumferential mating surface 47, being in the form of a frustoconical machine taper or male taper. More particularly, the second circumferential mating surface 47 is tapered to face outwardly away from the longitudinal conduit axis 43, in the downstream direction to provide complementary engagement with the female, first circumferential mating surface 27. In this way the second tubular body 41 is to be telescopically received within the first conduit 22 of the first tubular body to extend from the first opening 26 thereof with the first and second tapered mating surfaces (27 & 47) in mutually opposed abutment.

The circumferential fluid seal between the first tubular body 21 and the second tubular body 41 is provided by a second ring seal 52. The second ring seal 52 is disposed between the cylindrical surface portion 29 of the first conduit 22 and the outer surface of the second tubular body portion 41. A circumferential groove 53 in the tubular wall 50 receives and located the ring seal 51.

Figure 8:
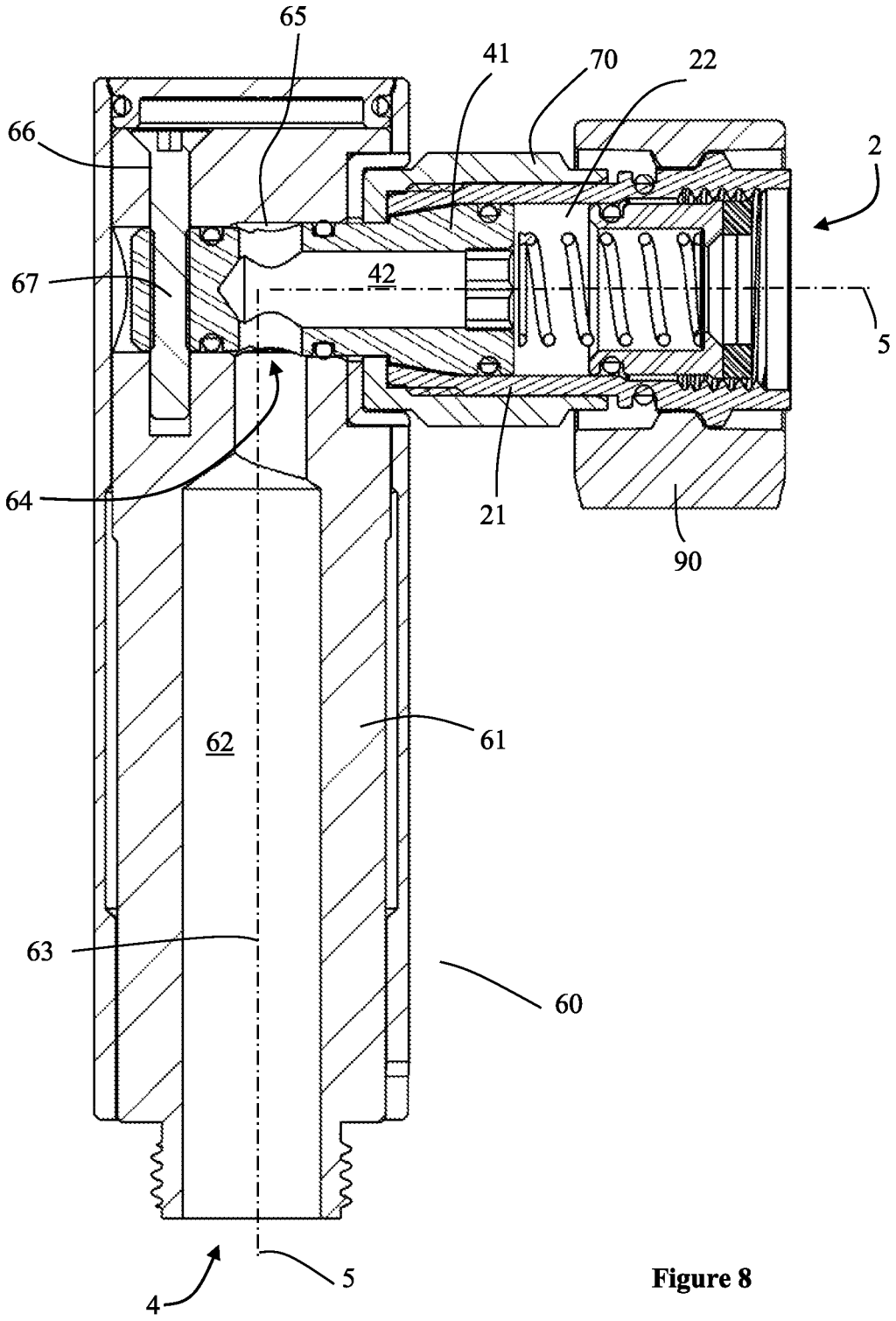
FIG. 8 is a sectioned side view of the adjustable fluidic coupling taken on section plane 4-4 of FIG. 4.

With reference to FIG. 8, the stem part 60 includes a third tubular body 61 having a first bore 65 intersecting the passageway 62 for receiving the downstream end portion of the second tubular member 40 such that the third opening 45 may be aligned with the fourth opening 64 and the third fluid passageway 62. Upon insertion of the end extension 50 of the second tubular body 41 into the first bore, the eyelet 50 is aligned with a threaded bore 66 in third tubular body 61 such that threaded pin 67 received in the bore 66 passes through the eyelet 51 to fix the second tubular body 41 to a third tubular body 81. A cover **67*a* is provided to conceal the end of the threaded pin 67. In this way the third tubular body 61 extends transverse the second tubular body 41** such that the longitudinal axis of the second and first tubular bodies are at an angle to the longitudinal axis of the third tubular body. In this embodiment the angle is 90 degrees, however other angles are contemplated.

The stem part may also include attachment hooks, formation or the like for connection of other shower components. For instance, in this embodiment the stem part 60 includes a hanger formation 69 for hanging a shower head handset.

Figure 9:
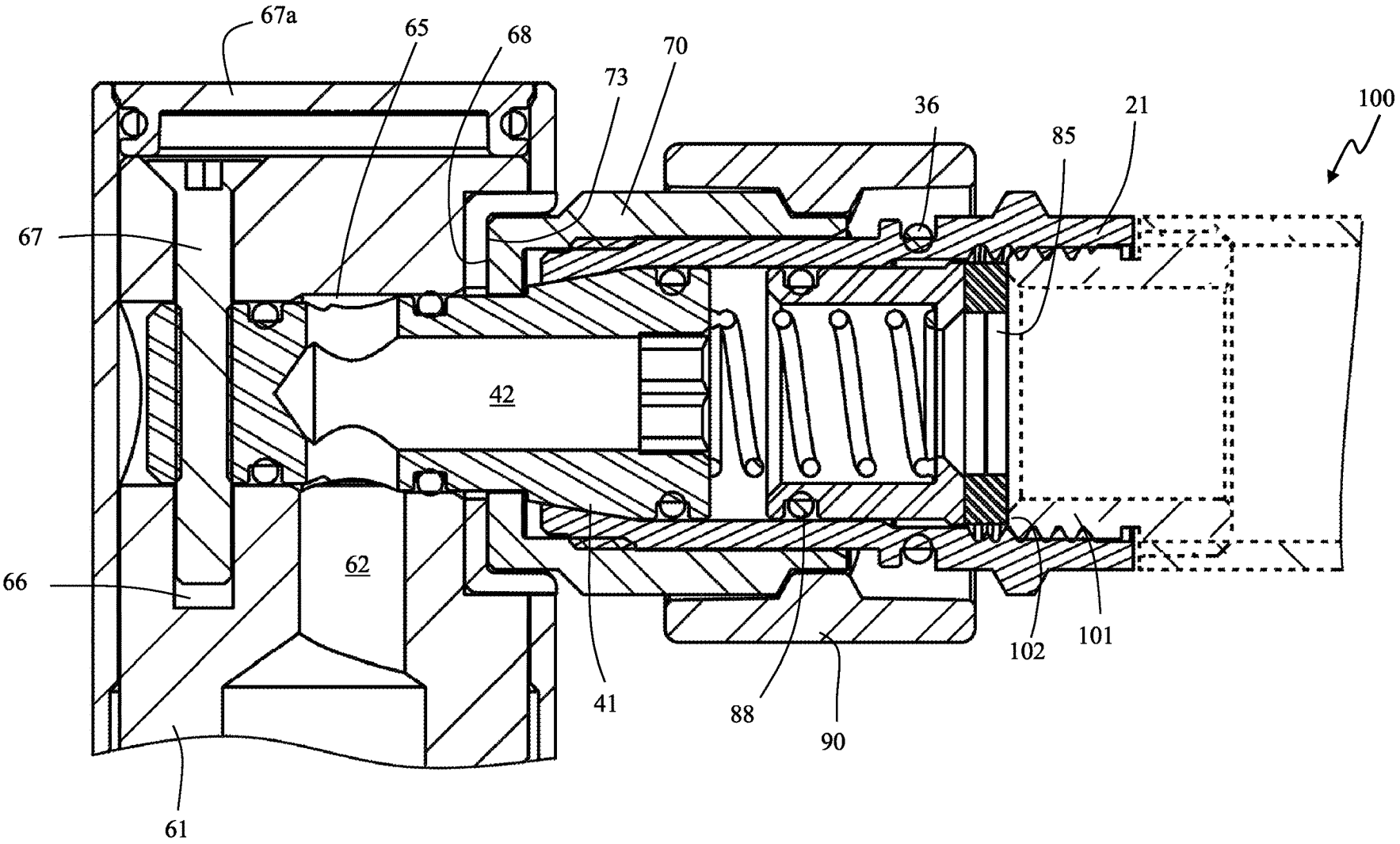
FIG. 9 is a detailed view of the section view of FIG. 8 including a portion of a shower arm to which the adjustable fluidic coupling is coupled in broken line.

With reference to FIG. 9, ring seals are provided on the external surface of the end extension to fluidly seal the second conduit to the third conduit. Each ring seal is located in a corresponding circumferential groove disposed either side of the third opening 45.

Figure 14:
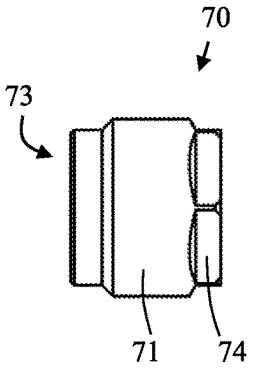
FIGS. 14 and 15 are a side view of a seal assembly in accordance with the invention and a section side view thereof taken on section plane 14-14 respectively.
Figure 16:
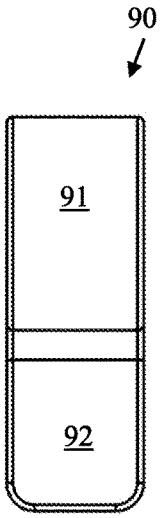
FIGS. 16 and 17 are a side view of a tool in accordance with the invention and a section side view thereof taken on section plane 16-16 respectively.
Figure 18:
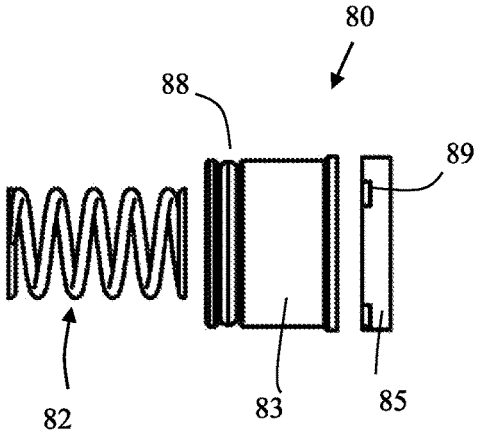
FIGS. 18 and 19 are a side view of a compression member in accordance with the invention and a section side view thereof taken on section plane 18-18 respectively.
Figure 15:
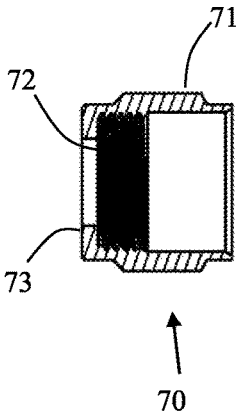
Figure 17:
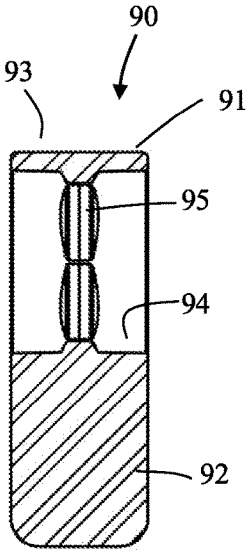
Figure 19:
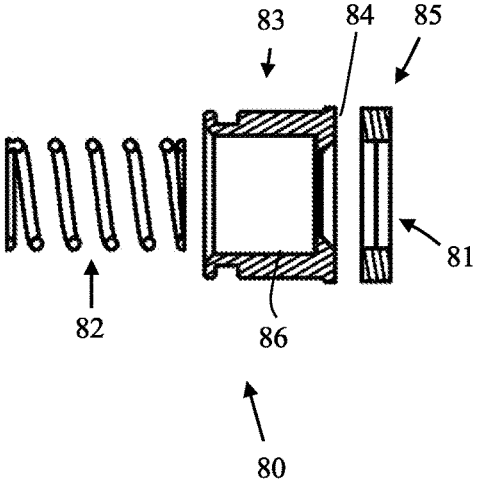

With reference to FIGS. 2, 14 and 15, in this embodiment the compression member 70 is a threaded travelling nut for threaded engagement with the threaded portion 34 on the external surface of the first tubular body 21. Preferably the threads are left hand threads. The compression member 70 comprises a tubular sleeve 71, having an internal thread 72 for engagement with the threaded portion 34 on the first tubular body 21, an annular abutment flange 73, and a second tool engagement formation 74 for engagement of a torqueing tool to apply torque to the compression member 70 and to thereby move the compression member 70, by means of threaded engagement of the internal thread 72 with the threaded portion 34 axially along the first tubular body 21. In this embodiment the second tool engagement formation 74 is provided by a portion of the tubular sleeve 11 having a hexagonal cross-section, however other tool engagement formations for applying torque to the first member may be used. Preferably the first tool engagement formation 33 on the first tubular body 21 and second tool engagement formation 74 on the compression member 70 are alike to enable engagement by the same tool.

In this embodiment, the annular seal 80 comprises a tubular seal carrier 83 slidably mounted within the cylindrical surface portion 31 of the first conduit 22. The carrier 83 includes an annular seal seat 84 for seating an annular seal member 85 configured for sealing engagement with the annular end surface 102 of the wall outlet 100 (see FIG. 9). A cylindrical wall 86 extends axially from a periphery of the annular seal seat 84 and includes a circumferential groove 87 for receiving and locating a ring seal 88 which provides a fluid seal between the circumferential wall 86 and the cylindrical surface portion 31 of the first conduit 22. The resilient member 82 is in the form of a coil spring disposed between the tubular seal carrier 83 and the upstream end portion of the second tubular body 41. The upstream end of the spring is received within the cylindrical wall 86 of the tubular seal carrier 83.

The tubular seal carrier 83 and annular seal member 85 are configured to slide axially within the first conduit 22 between an extended position where the annular seal member 85 is within the threaded portion 30 of the fluid inlet, and a retracted position where the annular seal member 85 is withdrawn into the first conduit 22 downstream of the threaded portion of the fluid inlet. Preferably, the annular seal member 75 is formed of a resilient material such as a plastics or rubber material and may include a filter.

Embodiments of the invention, such as that shown in the Figures further include a tool 90 for rotation of the compression member 70 so as to cause it to travel via threaded engagement with the first tubular body 21 between the first and second positions. The tool 90 is configured to engage the first and second tool engagement formations (33 & 74) located respectively on the first tubular body 21 and compression member 70. The tool 90 includes a tubular sleeve 91 and a lever 92 extending radially from an outer surface 93 of the sleeve 91 for the application of a moment force. An internal surface 94 of the tool includes a complementary rotational drive formation 95 for engaging the first and second tool engagement formations (33 & 74) located respectively on the first tubular body 21 and compression member 70. For instance, in this embodiment the rotational drive formation 95 is provided with a hexagonal cross section for receiving and engaging corresponding hexagonal first and second tool engagement formations (33 & 74) located respectively on the first tubular body 21 and compression member 60.

Referring to FIG. 8, the coupling 1 is assembled with the second tubular body 41 telescopically received within the first conduit 22 to extend from the first opening 26 thereof. The first and second tapered mating surfaces (27 & 47) are in mutually opposed abutment thereby preventing the second tubular body 41 passing wholly through the first conduit 22 and providing a machine taper joint between the first and second tubular bodies.

The first and second tapered mating surfaces (27 & 47) are preferably complementary self-releasing machine tapers having equal taper angles. Since the first and second tapered mating surfaces (27 & 47) are centered on the respective first and second port axes (28 & 48) which are respectively aligned with respective longitudinal axes (23 & 43), engagement of the first and second tapered mating surfaces (27 & 47) will align the first and second conduits on a common axis.

The compression member 70 is positioned with tubular sleeve 71 surrounding the downstream end portion of the first tubular body 21 such that the internal thread 72 and threaded portion 34 on the first tubular body 20 are threadedly engaged. The second tubular body 41 extends through the tubular sleeve 71 and is received in first bore 65 of the third tubular body 61 such that the third opening 45 of the second tubular body 41 is aligned with the fourth opening 64 of the third tubular body 61. The second tubular body 41 is fixed to the third tubular body 61 by the threaded pin 67 which is received in the threaded bore 66 and passes through the eyelet 50 of the second tubular body 41. The annular abutment flange 73 of the compression member 70 abuts stop surface 68 on the third tubular body 61.

Axial rotation of the tubular sleeve 71 causes the compression member 70 to travel axially along the threaded portion 34 of the first tubular body 21. Axial travel of the compression member 70 along the first tubular body 21 in the downstream direction brings the annular abutment flange 73 into contact with the stop surface 68 on the third tubular body 61. Since the second and third bodies are fixedly connected, further travel of the compression member 70 in the downstream direction (second position) acts to increase the spacing between the first member 21 and the second/third tubular bodies (41 & 71) thereby pressing the first and second tapered mating surfaces (27 & 47) together. The application of sufficient compressive load causes the first and second tapered mating surfaces (27 & 47) to frictionally bind thereby fixing the first tubular body 21 relative to the second tubular body 41. Release of the compressive load across the first and second tapered mating surfaces (27 & 47) by axial travel of the compression member 70 along the first tubular body 21 in the upstream direction (first position) allows separation of the first and second tapered mating surfaces (27 & 47) and relative rotation of the first tubular body 21 relative to the second tubular body 41.

The coil spring 82, tubular seal carrier 83 and annular seal member 85 are slidably mounted within the cylindrical surface portion 31 of the first conduit 22. The annular seal member 85 includes radial projections 89 which engage between the threads of the threaded portion 30 of the inlet 2. As can be in FIG. 8 the projections hold the tubular seal carrier 83 and annular seal member 85 within the inlet 2 preferably adjacent the upstream end of the threaded portion 30 against bias of the coil spring 82.

The tubular sleeve 91 of the tool 90 surrounds the coupling 1. The sleeve 91 and rotational drive formation 95 are sized to permit sliding movement of the tool along the coupling 1 between first and second tool engagement formations (33 & 74). Furthermore, in this embodiment axial travel of the tool 90 along the coupling 1 is limited by abutment of the rotational drive formation 95 against enlarged flange portion 32 of the first tubular body 21 in the upstream direction and the tubular sleeve 71 in the downstream direction thereby captively retaining the tool to the coupling. Furthermore, the O-ring 36 located on the outer surface of the first member 20 provides a point of resistance to axial movement of the tool. This helps retain the tool in engagement with the first tool engagement formations 33 whereby the sleeve 91 surrounds and conceals the first and second tool engagement formations providing a more pleasing aesthetic.

In use, the coupling 1 is to be connected to the outlet 100 by threaded engagement of the inlet 2 threaded portion 30 with the threaded end 101 of the wall outlet 100 (shower wall arm). The tool 90 may be positioned axially relative to the coupling 1 by sliding the tubular sleeve 91 along the coupling toward the inlet such that the rotational drive formation 95 engages the first tool engagement formation 33.

The coupling is screwed on to the outlet 100 until a hard stop is reached, typically by exhaustion of the threaded portions on either on the inlet 2 or wall outlet 100, or by abutment of the annular end of the inlet 2 with an annual step surrounding the threaded end 101 of the wall outlet 100. The tool 90 is then used to torque the first tubular body 21 to resist relative rotation of the coupling relative to the outlet. It will be appreciated that the torque applied directly determines the resistance to relative rotation of the coupling relative to the outlet.

As the first tubular body 21 is screwed on to the wall outlet 100 the annular seal member 85 engages the annular end surface 102 of the wall outlet 100. As the end surface 102 advances into the inlet 2, the tubular seal carrier 83 and annular seal member 85 are forced to slide within the cylindrical surface portion 31 of the first conduit 21 against the resilient bias of the coil spring 82. Urging of the spring 82 on the seal carrier 83 holds the annular seal member 85 in sealing contact with the annular end surface 102 of the wall outlet 100 to provide a fluid tight seal.

The tubular seal carrier 83 and annular seal member 85 are configured to withdraw within the cylindrical surface portion 31 of the first conduit 22 downstream of the threaded portion 30 thereby reducing the likelihood that slidable travel of the tubular seal carrier 83 and annular seal member 85 is exhausted before exhaustion of the threaded portions on either on the inlet 2 or wall outlet 100. That is to say, to reduce the risk of over compression of the annular seal member and subsequent seal failure. Rather, sealing pressure of the annular seal member against the annular end surface 102 of the wall outlet 100 is limited by bias provided by the coil spring 88 and generally independent of torque applied.

Once the first tubular body 21 is tightened to the wall outlet 100, the tool 90 may be re-positioned axially relative to the coupling 1 such that the rotational drive formation 95 engages the second tool engagement formation 74. If required, the compression member 70 is rotated with the tool 90, to release any compressive load applied by the compression member 70 to the coupling thereby allowing relative rotation between the first and second tubular bodies (21 & 41) about the common axis.

The second tubular body 41 is then able to be rotated to adjust the angular orientation of the fluid outlet/second/third bodies. The tool 90 is then used to move the compression member 70 axially along the first tubular body 21 of first tubular body 21 in the downstream direction so that the annular abutment flange 73 is brought into contact with the stop surface 68 on the third tubular body 60 and the first mating surface 27 is compressively engaged with the second mating surface 47 to provide frictional binding therebetween to angularly fix the first tubular body 21 relative to the second tubular member 41 and third tubular body 61 bearing the outlet 4. As noted, the threaded connection between the first tubular body 21 and the compression member 70 is preferably a left-hand thread such that the tightening direction is consistent with the tightening direction for connection of the first tubular body 21 to the wall outlet 100.

It should be noted also that the annular abutment flange 73 may also be engaged with a shoulder 55 disposed on the second member 41 in order to separate the first and second tapered mating surfaces (27 & 47) which over time, may stick together.

Figure 21:
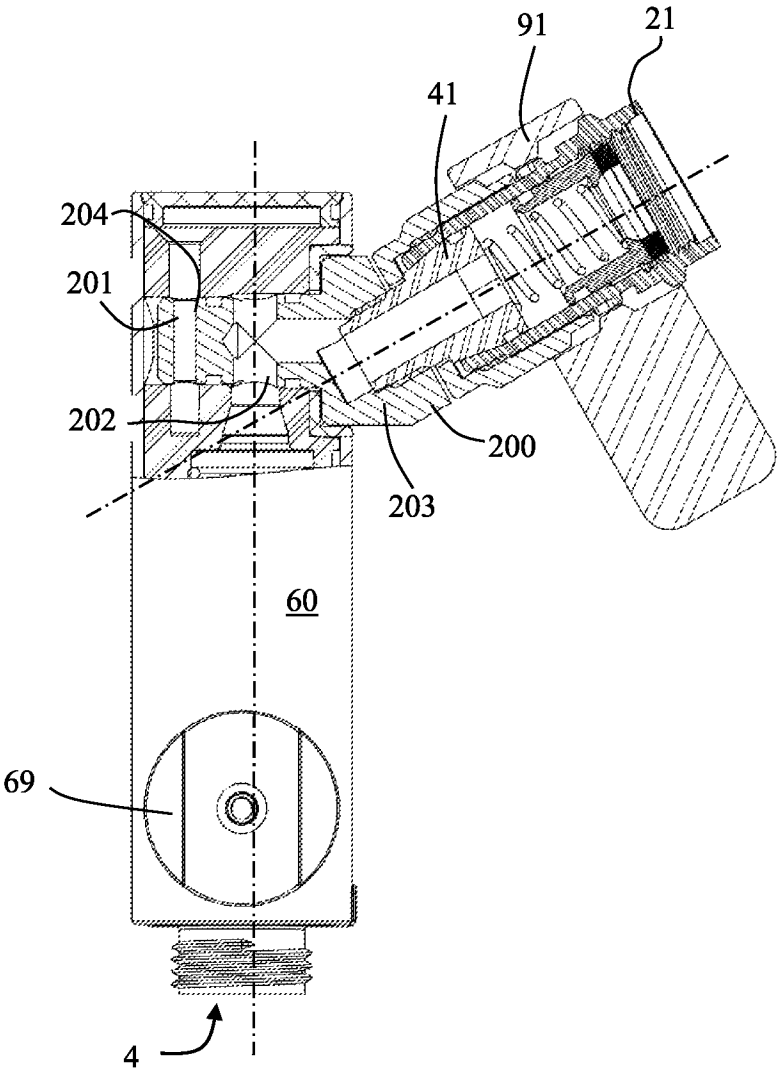
FIG. 21 is a partial section side view of the adjustable fluidic coupling shown in FIG. 20.
Figure 20:
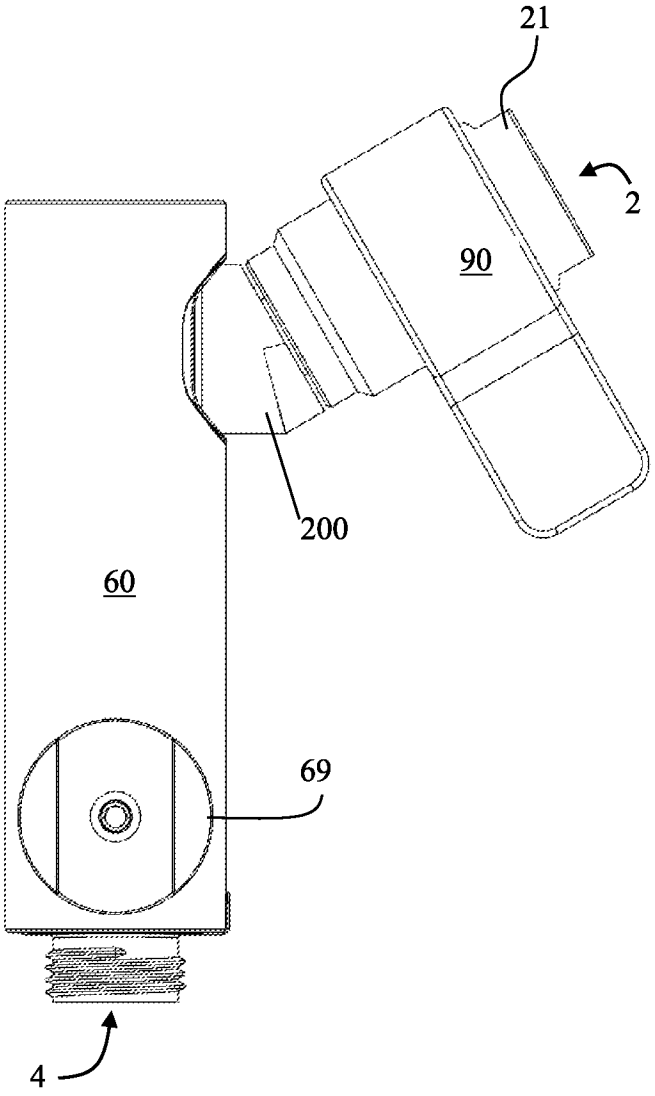
FIG. 20 is a side view of another adjustable fluidic coupling in accordance with the invention.
Figure 22:
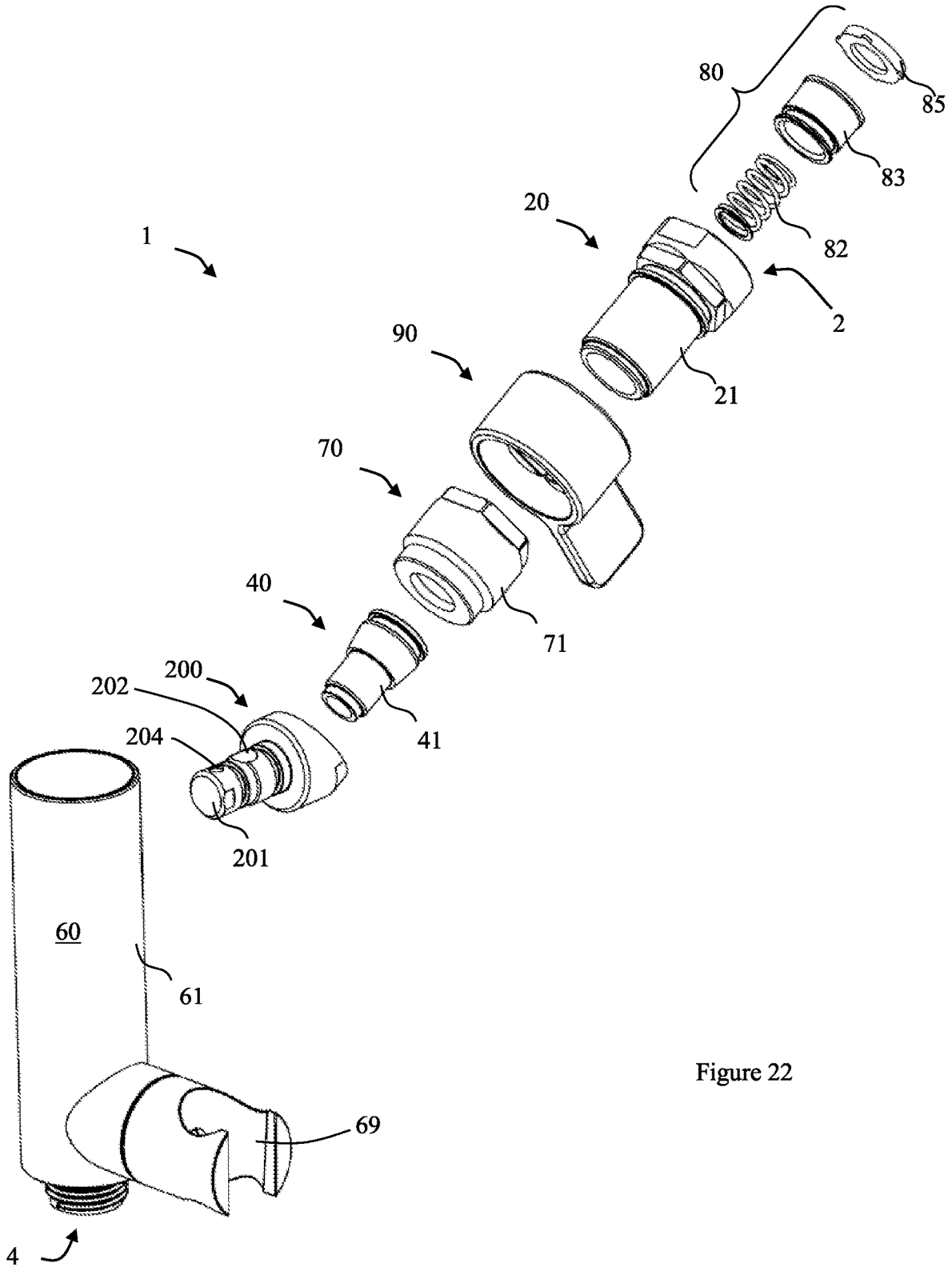
FIG. 22 is exploded perspective view of the adjustable fluidic coupling shown in FIG. 20.

An alternative embodiment of the adjustable fluidic coupling 1 is shown in FIGS. 20 to 22. In this embodiment the first and third bodies (21 and 61) are as described in the first embodiment, as are the compression member 70, annular seal 80 mounted within the inlet 2, and tool 90.

In this embodiment however the stem part 80 further includes a connector spigot 200 in addition to the third tubular body 61. The connector spigot 200 supports the fourth upstream opening 64 of the stem part 60, and is configured to be fixedly connected to the third body 61 to provide the fluid passageway 62 connecting the fourth opening 64 and the outlet 4 at a downstream end portion of the stem part 60.

At a downstream axial end, the connector spigot 200 is closed by means of an end extension 201 and a fifth opening 202 extends laterally through a spigot wall 203. It will be noticed that the fourth upstream opening 64 is set at an angle to the fifth opening 202.

The end extension 201 is configured to be received in the first bore 65 in the third tubular body 61 in the same way the end extension of the second tubular body 41 is received in the stem part 60 in the previous embodiment. The end extension 201 further includes an eyelet 204 configured for fixing to the third body 61 such that upon insertion of the end extension 201 the first bore 65, the eyelet 204 is aligned with a threaded bore 66 in third tubular body 61 and a threaded pin 67 received in the bore 66 passes through the eyelet 204 to fix the connector spigot 200 to the third tubular body 61.

Ring seals are provided on the external surface of the end extension 201 to fluidly seal the fluid passageway 5 between the third body 61, and the angled connector spigot 200. Each ring seal is located in a corresponding circumferential groove disposed either side of the fifth opening 202.

As noted previously, in this embodiment the second body 41 differs from the previous embodiment in that the third opening 45 is located on the downstream axial end of second body 41 and centered on the longitudinal axis 43. The second tubular body 41 further includes a threaded end portion 56 adjacent the third opening 45 which is threadedly secured to a complementary threaded portion on the connector 200 which is in turn fixed to the third body 61.

It will be appreciated that the fluidic coupling may provide a number of advantages over the prior art.

First, the coupling allows the installation of a shower head or other water outlet fitting where the sealing function is generally independent of the tightening torque applied. Higher torques may typically be applied to prevent rotation of the fitting, without damaging sealing components. Furthermore, the alignment of the outlet with respect to the inlet may be adjusted as required to enable correct orientation of the fitting.

Although the invention has been described with reference to a preferred embodiment, it will be appreciated by those skilled in the art that the invention may be embodied in other forms.

The advantageous embodiments and/or further developments of the above disclosure—except for example in cases of clear dependencies or inconsistent alternatives—can be applied individually or also in arbitrary combinations with one another.

The invention claimed is:

1. An adjustable fluidic coupling to be fitted to a fluid dispensing wall outlet, wherein the coupling comprises:

a fluid channel extending between an upstream fluid inlet and a downstream fluid outlet;

an inlet part formed of at least one tubular body and comprising a first conduit extending therethrough along a first longitudinal axis between the inlet at an upstream end and a first connection port at a downstream end portion, said port having a first fluid opening and a first circumferential tapered mating surface aligned on a first port axis;

an outlet part formed of at least one tubular body and comprising a second conduit extending therethrough along a second longitudinal axis between a second connection port at an upstream end portion, said second port comprising a second fluid opening and a second circumferential tapered mating surface aligned on a second port axis, and a third opening at a downstream end portion;

a stem part comprising a stem axis and fluid passageway extending between a fourth opening at an upstream end portion and the outlet at a downstream end portion;

wherein the first and second ports are configured for complementary tapered engagement of the first and second mating tapered surfaces on aligned port axes to connect the inlet part to the outlet part such that the first and second conduits are in fluid communication via the first and second openings and form said fluid channel between the inlet and the outlet;

wherein said outlet part is fixedly connected to said stem such that said second conduit and said passageway are fluidly connected by said third and fourth openings;

a compression member selectively movable between a first position holding the first and second mating surfaces in abutment for free rotation of the inlet part about the coaligned port axes relative to the outlet part thereby providing for angular adjustment of the inlet relative to the outlet, and a second position whereby the first mating surface is compressively engaged with the second mating surface to frictionally bind the first and second mating surfaces to angularly fix the inlet relative to the outlet;

wherein said fluid inlet comprises a threaded portion for torqued threaded connection of said inlet to a threaded end of said wall outlet, to thereby resist relative rotation of said coupling relative to said outlet; and an inlet seal fluidly sealing the inlet port to the wall outlet.

2. The adjustable fluidic coupling of claim 1, wherein said inlet seal comprises:

an annular seal mounted within the inlet adjacent the threaded portion, said annular seal providing a fluid seal between an inner cylindrical surface portion of the first conduit and an annular end surface of said wall outlet; and a resilient member for biasing the annular seal into sealing engagement with the annular end surface of said wall outlet.

3. The adjustable fluidic coupling of claim 2 wherein said annular seal comprises:

a tubular seal carrier slidably mounted within the cylindrical surface portion of the first conduit, said carrier having an annular seal seat for seating an annular seal member for sealing against the annular end surface of said wall outlet;

a first ring seal for providing a fluid seal between an outer surface of said tubular seal carrier and the cylindrical surface portion of the first conduit.

4. The adjustable fluidic coupling of claim 3 wherein the tubular seal carrier and annular seal member are slidable between an extended position where the annular seal member is within the threaded portion of the fluid inlet, and a retracted position where the annular seal member is in the first conduit downstream of the threaded portion of the fluid inlet.

5. The adjustable fluidic coupling of claim 3 wherein the tubular seal carrier includes a tubular wall extending axially from a periphery of the annular seal seat, the tubular wall including a circumferential groove for receiving and locating the first ring seal.

6. The adjustable fluidic coupling of claim 1 wherein said first and second tapered mating surfaces are complementary frustoconical machine tapers.

7. The adjustable fluidic coupling of claim 6 wherein said machine tapers are self-releasing.

8. The adjustable fluidic coupling of claim 1 wherein the tubular body of the inlet part is a first tubular body, having a first longitudinal axis and a first tubular wall defining said first conduit, and wherein said inlet and the first downstream opening are disposed at respective upstream and downstream ends thereof.

9. The adjustable fluidic coupling of claim 8 wherein the tubular body of the outlet part is a second tubular body having a second longitudinal axis and a second tubular wall defining said second conduit, and wherein said second downstream opening and said outlet are disposed at respective upstream and downstream ends thereof.

10. The adjustable fluidic coupling of claim 9 wherein said first mating surface is disposed on an inner surface of the first tubular wall of the first tubular body and said second mating surface is disposed on an outer surface of the second tubular wall of the second tubular body.

11. The adjustable fluidic coupling of claim 10 wherein said second tubular body is telescopically received within the first tubular body to extend from the first downstream opening thereof.

12. The adjustable fluidic coupling of claim 11 wherein second tubular body extends at least partially into said first tubular body.

13. The adjustable fluidic coupling of claim 12 further including a second ring seal disposed between an inner surface of the first conduit and an outer surface of said second tubular body adjacent the second opening to provide a fluidic seal between the coupling inlet part and the coupling outlet part.

14. The adjustable fluidic coupling of claim 13 further including a circumferential groove disposed on the outer surface of second tubular body for receiving and locating the second ring seal.

15. The adjustable fluidic coupling of claim 9 wherein said stem extends transverse said second tubular body.

16. The adjustable fluidic coupling of claim 15 wherein said stem axis is at an angle of between around 45 and around 90 degrees to said second longitudinal axis.

17. The adjustable fluidic coupling of claim 10 wherein said stem comprises a third tubular body and an angled connector spigot;

and wherein said second and third tubular bodies are fixedly connected to the connector at respective downstream and upstream end portions such that the second and third conduits are in fluid communication via an interconnecting fluid passageway through said connector.

18. The adjustable fluidic coupling of claim 9 wherein said second conduit is closed at a downstream end and said third opening extends through a sidewall of said downstream end portion of said second tubular body.

19. The adjustable fluidic coupling of claim 9 wherein said compression member is a tubular travelling nut surrounding said first tubular body and threadably engaged therewith such that rotation of said compression member causes axial travel of said compression member with respect to said first tubular body between said first and second positions.

20. The adjustable fluidic coupling of claim 19 wherein said compression member includes a first compression surface for engaging a second compression surface disposed on said coupling outlet part when in said second position to invoke compressive engagement of the first mating surface with the second mating surface.

21. The adjustable fluidic coupling of claim 20 further including a torqueing tool having a rotational drive formation for engaging complementary first and second tool engagement formations located respectively on the first tubular body and the compression member, and wherein the tool includes a tubular tool sleeve coaxially mounted on said coupling for slidable movement between a first and second positions wherein said rotational drive formation is disposed on an inner surface of said sleeve; such that in the first position said rotational drive formation is engaged with said first tool engagement formations and in the second position said rotational drive formation is engaged with said second tool engagement formations.

22. An adjustable fluidic coupling to be fitted to a fluid dispensing wall outlet, wherein the coupling comprises:

a fluid channel extending between an upstream fluid inlet and a downstream fluid outlet;

an inlet part formed of at least one tubular body and comprising a first conduit extending therethrough between the inlet at an upstream end and a first connection port at a downstream end portion, said port having a first fluid opening and a first circumferential tapered mating surface aligned on a first port axis;

an outlet part formed of at least one tubular body and comprising a second conduit extending therethrough between the outlet at a downstream end and a second connection port at an upstream end portion, said second port comprising a second fluid opening and a second circumferential tapered mating surface aligned on a second port axis;

wherein the first and second ports are configured for complementary tapered engagement of the first and second mating tapered surfaces on aligned port axes to connect the inlet part to the outlet part such that the first and second conduits are in fluid communication via the first and second openings and form said fluid channel between the inlet and the outlet;

a compression member selectively movable between a first position holding the first and second mating surfaces in abutment for free rotation of the inlet part about the coaligned port axes relative to the outlet part thereby providing for angular adjustment of the inlet relative to the outlet, and a second position whereby the first mating surface is compressively engaged with the second mating surface to frictionally bind the first and second mating surfaces to angularly fix the inlet relative to the outlet;

wherein said fluid inlet comprises a threaded portion for torqued threaded connection of said inlet to a threaded end of said wall outlet, to thereby resist relative rotation of said coupling relative to said outlet; and an inlet seal fluidly sealing the inlet port to the wall outlet.

* * * * *